US006095758A

United States Patent [19]

Chou

[11] Patent Number: 6,095,758

[45] Date of Patent: Aug. 1, 2000

[54] STRUCTURE FOR A COMPACT AIR COMPRESSOR

[76] Inventor: Wen-San Chou, P.O. Box 82-144, Taipei, Taiwan

[21] Appl. No.: 09/049,904

[22] Filed: Mar. 30, 1998

[51] Int. Cl.[7] ..... F02B 49/00; F02B 9/14

[52] U.S. Cl. ..... 417/63; 417/374

[58] Field of Search ..... 417/63, 283, 307, 417/313, 321, 374

[56] References Cited

U.S. PATENT DOCUMENTS 5,836,747 11/1998 Gondek ..... 417/63

*Primary Examiner*—Thomas N. Moulis
*Attorney, Agent, or Firm*—A & J

[57] ABSTRACT

An improved structure for a compact air compressor including a securing seat, a transmission device, and a compression device. The securing seat is connected to a motor by means of screw rods. A shaft receiving hole is provided at the bottom of the securing seat, and a compression cylinder is disposed on the top. A top tube connected to a threaded tube and a guide tube is disposed on top the compression cylinder. The transmission device includes a weight, a link shaft, and a transmission gear. The compression cylinder contains the compression device, which is comprised of a link, a piston container, a compression valve, and a compression positioning block. The bottom of the link is pivotally connected to a connecting rod at the top of the weight. The motor has a main gear which drives the transmission gear to cause the weight disposed in a receiving recess thereof to actuate the link, thereby air may be pushed to the top tube and discharged from the guide tube. The transmission gear includes two gear halves of different thicknesses. The thicker toothed surface of the transmission gear ensures greater pushing force and prevent damage to the teeth of the transmission gear and the main gear. Air intake is also sped up and friction reduced. Air output efficiency is enhanced and manufacturing costs lowered.

1 Claim, 6 Drawing Sheets

STRUCTURE FOR A COMPACT AIR COMPRESSOR

BACKGROUND OF THE INVENTION

1. Field of the Invention

The present invention relates generally to an improved structure for compact air compressors, and more particularly to a compact air compressor which is easy to assemble and has high air output efficiency.

2. Description of the Prior Art

FIG. 6 shows a conventional air compressor, which comprises a motor 5, a securing plate 6, a transmission gear 7, a compression cylinder 8, and a connecting disk 9. The motor 5 and securing plate 6 are screwably locked together by bolts 50. A guide gear 51 is fixedly provided at the spindle of the motor 5. The horizontal end of the securing plate 6 is formed with a cylinder hole 60 and a plurality of screw holes 61. The vertical end of the securing plate 60 is provided with upper and lower gear holes 62, 63. The upper gear hole 62 allows the passage of a spindle of the guide gear 51 of the motor, whereas the lower gear hole 63 receives a connecting tube 64 and one end of a spindle of the transmission gear 7. A C-clip 65 is used to fasten them in place. Reinforcing ribs 66 are disposed at the joint between the vertical end and horizontal end of the securing plate 6. At the same time, the transmission gear 7 is provided on the securing plate 6 and engages the guide gear 51. One end of the transmission gear 7 is provided with a weight 70. The other end thereof has a connecting rod 71 extending therefrom. The connecting rod 71 is pivotally connected to the bottom of a link 80. The top end of the link 80 is pivotally connected to a piston 82 by means of a shaft 81. The top end of the piston 82 is fitted with a compression block 83 and a ring 84 in sequence. By means of a through lower air hole 85, the top portion of the compression block 83 may be coupled to a packing piece 86 and movably connected with a cover plate 87 assembled into the compression cylinder 8, whereby the compression cylinder 8 may generate a pushing force due to rotation of the motor 5. Furthermore, the upper end of the compression cylinder 8 is connected to the connecting disk 9, which is peripherally provided with a plurality of connecting elements 90. Bolts 91 are passed through round holes 92 of the connecting elements 90 and the screw holes 61 of the securing plate 6 to lock the connecting disk 9, the compression cylinder 8, and the securing plate 6 as a whole. The connecting disk 9 is further provided with an upper air hole 93 which is connected to a packing piece 94 and a cover plate 95. The upper air hole 93 cooperates with the lower air hole 85 of the the piston 82 to achieve the drawing in and discharge of air, the air being output from a guide tube 96 connected to one end of the connecting disk 9.

As can be seen, the conventional air compressor is very complicated in structure and assembly thereof is also difficult. The drawbacks of conventional air compressors are summed up as follows:

1. Air discharge control effects achieved by utilizing displacement of the ring 84 of the compression block 83 inside the compression cylinder 8 are not complete.
2. Assembly is inconvenient and troublesome as the link 80 is coupled to the piston 82 by means of the shaft 81 and the upper end of the piston 82 has the compression block 83 and the ring 84 fitted thereon. And besides, manufacturing costs are relatively high and production speed low.
3. As the securing plate 6 and the compression cylinder 8 are coupled in a separated manner, manufacture of the air compressor is made difficult. Additionally, the securing plate 6 cannot constitute a preferred structure in which the fulcrum is located between the point of force application and the point of resistance.
4. As the transmission gear is provided with a weight, the load borne by the gear from rotation to air intake is relatively large, so that the friction coefficient between pitches increases, which may damage the transmission gear and affect intake and output air pressure.

SUMMARY OF THE INVENTION

The present invention relates generally to an improved structure for compact air compressors, and more particularly to a compact air compressor which is easy to assemble and has high air output efficiency.

Accordingly, a primary object of the present invention is to provide an improved structure for compact air compressors to eliminate the drawbacks with the prior art.

DETAILED DESCRIPTION OF THE PREFERRED EMBODIMENT

Figure 1:
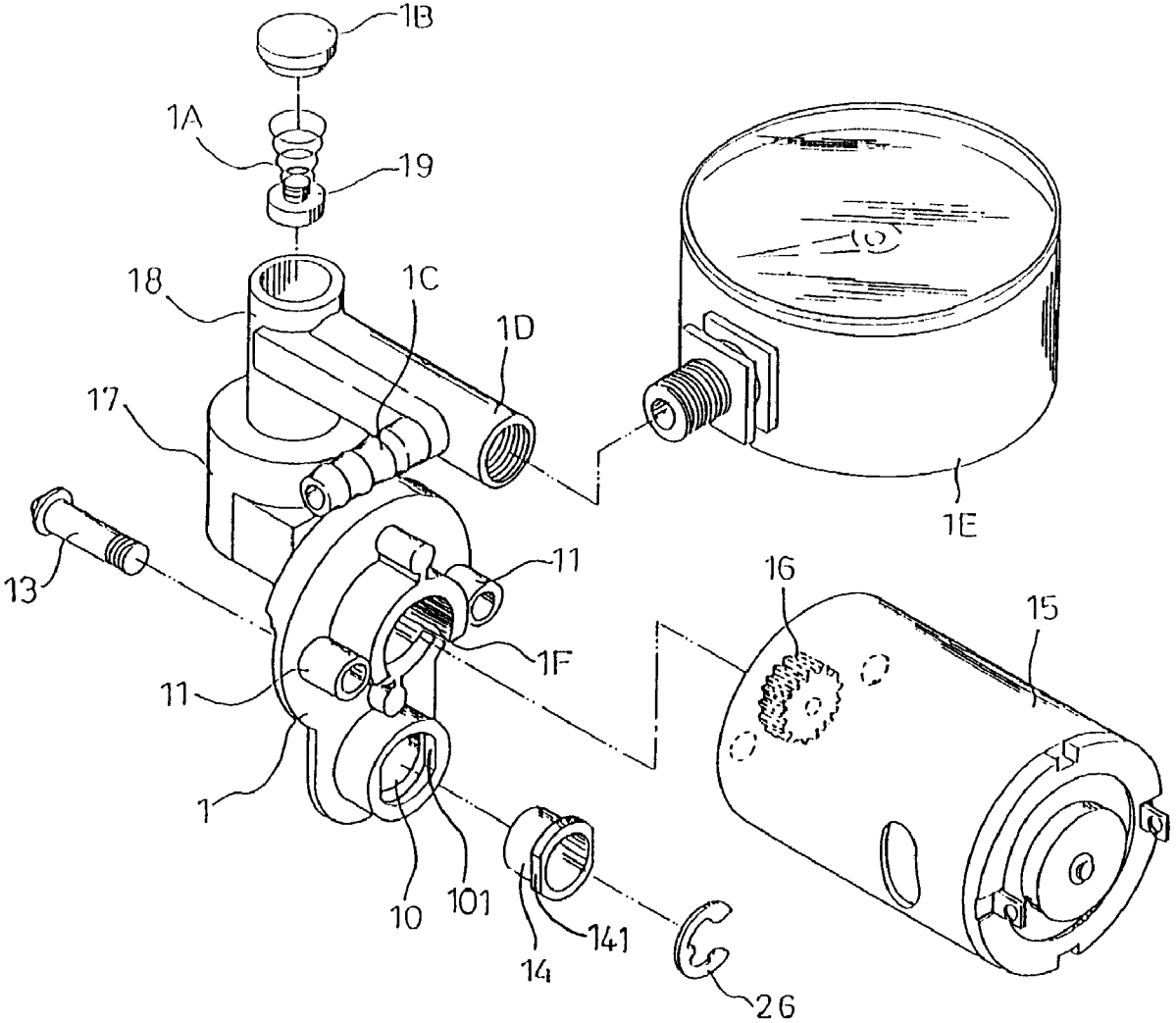
FIG. 1 is a perspective exploded view of the present invention in part.
Figure 2:
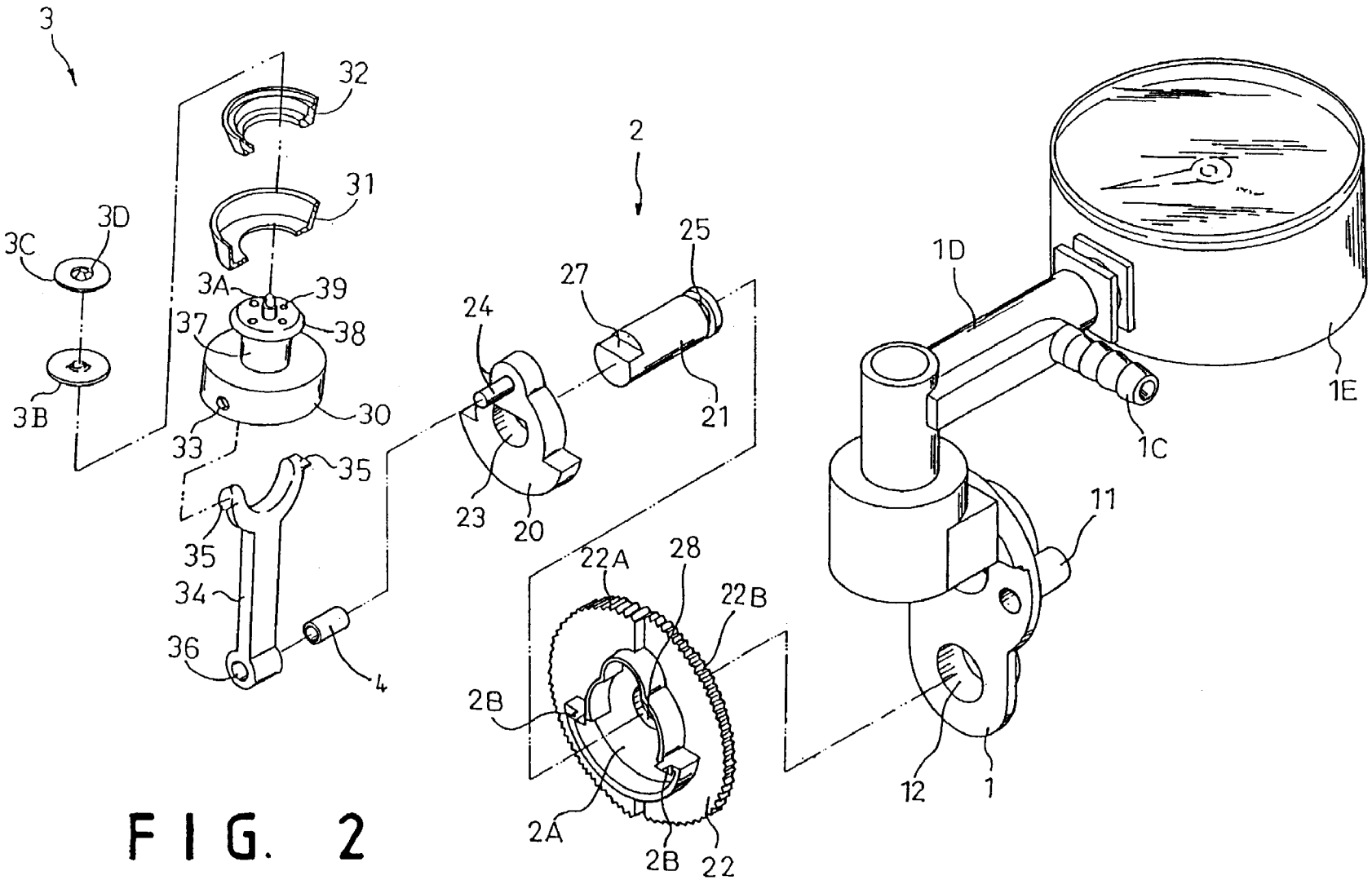
FIG. 2 is another perspective exploded view of the present invention in part.
Figure 3:
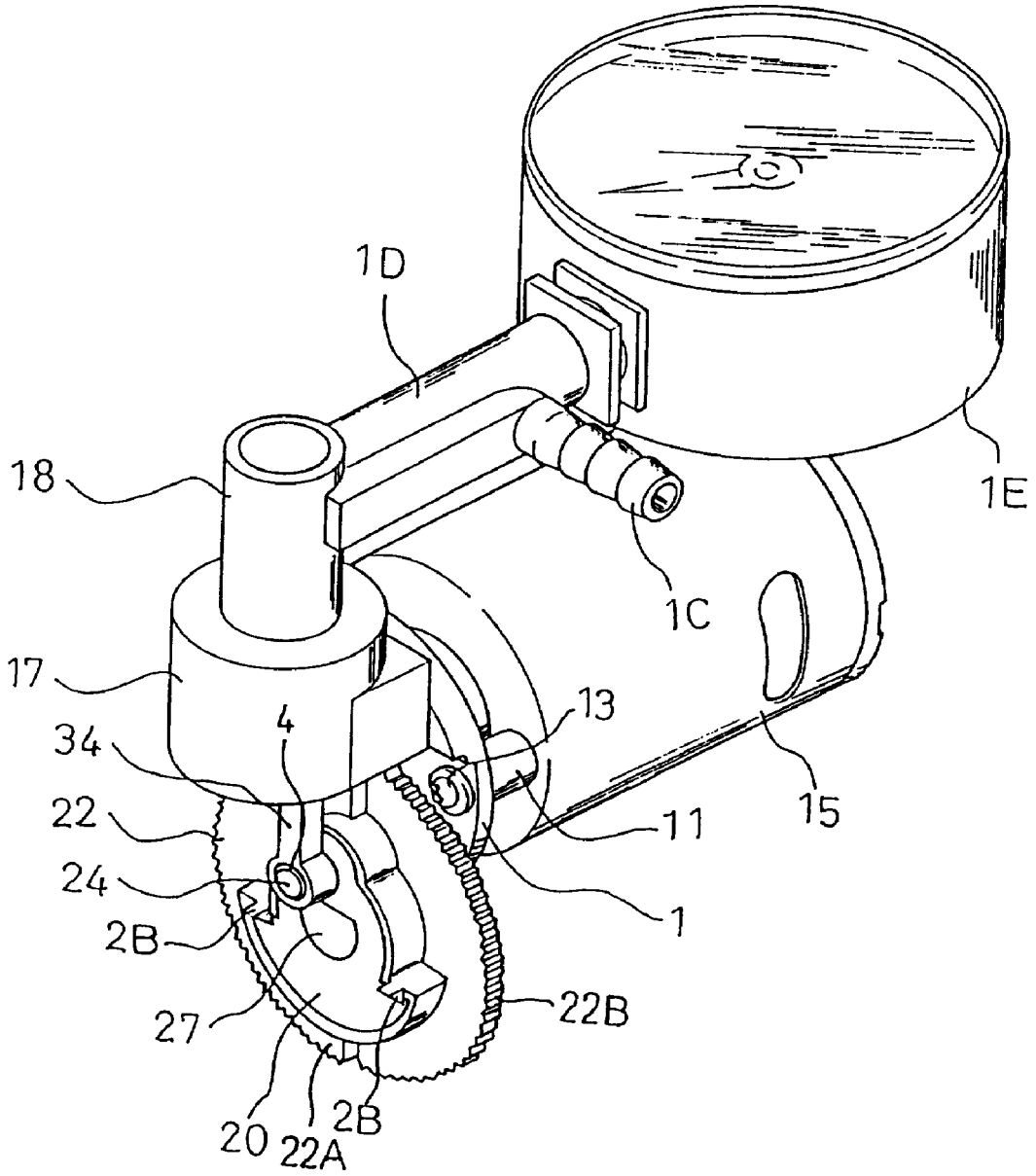
FIG. 3 is an assembled view of the present invention.
Figure 4:
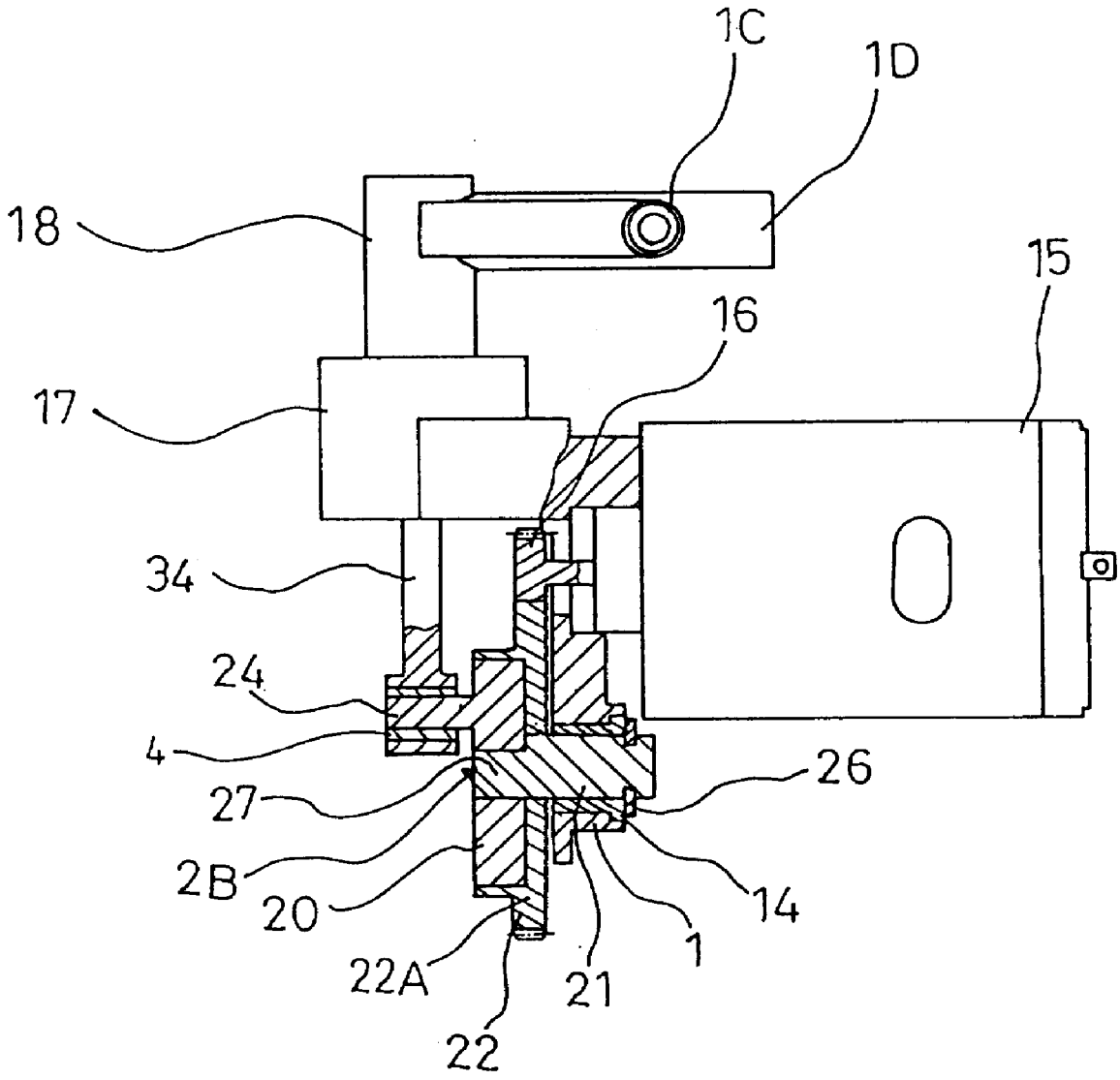
FIG. 4 is a sectional view of the present invention illustrating the connection between the shaft receiving hole and the other structural elements.

With reference to FIGS. 1 and 2, the present invention comprises a securing seat 1, a transmission device 2, and a compression device 3.

The securing seat 1 is an integrally formed structure having a body which includes a cylindrical receiving slot 10 communicating with a shaft receiving hole 12 at an opposite side, and a pair of fitting tubes 11 for securing screw rods 13. The receiving slot 10 is provided with two opposite planar portions 101 for receiving a sleeve 14 having a projecting rim with opposite planar portions 141 so as to prevent rotation of the sleeve 14. After the screw rods 13 are passed through the fitting tubes 11, they are screwably locked with a motor 15 having a main gear 16 as a whole. An integrally formed compression cylinder 17 is disposed on the securing seat 1 at a suitable position for mounting a compression device 3. A top end of the compression cylinder 17 is connectably provided with a top tube 18 which is internally provided with a valve block 19 and a spring 1A. The top tube 18 is sealed by a cover 1B urged by the spring 1A to serve as a gas flow control. A guide tube 1C and a threaded tube 1D respectively extend from the body of the top tube 18. The threaded tube 1D is adapted to screwably connect with a pressure gage 1E as a whole.

The transmission device 2 includes a weight 20, a link shaft 21, and a transmission gear 22. The weight 20 is centrally formed with a substantially semi-circular shaft hole 23 and has a connecting rod 24 extending from a top end thereof to insert into a connecting hole 36 of a link 34 (to be described hereinafter). The connecting hole 36 has a bushing 4 placed therein to enhance the smoothness of rotation of the connecting rod 24 and reduce friction. One end of the link shaft 21 is provided with an insert portion 27 which is substantially semi-circular, with the other end provided with a fastening groove 25. The transmission gear 22 is provided with a receiving recess 2A shaped to match the weight 20. The receiving recess 2A has two shoulders, and a retaining block 2B is disposed at each shoulder. Furthermore, the transmission gear 2 is centrally provided with a through hole 28. One half of the transmission gear 22 is provided with a thick toothed surface 22A. The other half thereof is provided with a thin toothed surface 22B. The link shaft 21 is passed through the shaft receiving hole 12 of the securing seat 1 and the sleeve 14 with projecting rim. By means of an E-shaped fastening clip 26, the link shaft 21 is secured in the fastening groove 25. The shaft hole 23 of the weight 20 is insertable into the insert portion 27 to prevent slippage of the weight 20 and the transmission gear 22 from the link shaft 21. At the same time, the weight 20 may just fit into there ceiving recess 2A, and the retaining blocks 2B at both shoulders of the receiving recess 2A may be utilized to position the weight in the transmission gear 22 of two different thicknesses.

The compression device 3 is comprised of a piston container 30, a compression valve 31, a compression positioning block 32, and a link 34. The bottom portion of the piston container 30 is provided with pin holes 33 to allow the bevel pins 35 at the top ends of the link 34 to fit therein so as to achieve a linking-up structure. A bottom portion of the link 34 is provided with the above-mentioned connecting hole 36 for receiving the bushing 4 and the above-mentioned connecting rod 24. The link 34 may, by means of the turning of the link shaft 21, guide the movement of the piston container 30. A fastening post 37 extends from the top end of the piston container 30, and a bevel fastening portion 38 is formed at the top end of the fastening post 37 for fastening both the positioning block 32 and the compression valve 31 to prevent their slippage. The fastening post 37 is further provided with an air inlet 39 which communicates with the piston container 30. An insert pin 3*a* further extends from the top side of the fastening post 37 on which a valve piece 3B is disposed and secured in place by the fastening portion of a limiting piece 3C.

Assembly of the present invention is now described with reference to FIGS. 1–4. The sleeve 14 is firstly fitted into the receiving slot 10 of the securing seat 1. At this point, the link shaft 21 may be passed through the shaft receiving hole 12 and the sleeve 14. Then the weight 20 is fitted into the receiving recess 2A and positioned in place by the retaining blocks 2B. One end of the link shaft 21 is passed in sequence through the through hole 28 of the transmission gear 22 and the shaft hole 23 of the weight 20 by means of the insert portion 27, the weight 20 and transmission gear 22 being prevented from slippage from the link shaft 21 by the insert portion 27 and retaining blocks 2B. The other end of the link shaft 21 is secured to the securing seat 1 by means of the E-shaped fastening ring 26 which engages the fastening groove 25 of the link shaft 21. Next, the connecting rod 24 of the weight 20 is passed through the bushing 4 fitted into the connecting hole 36 of the link 34 to allow coupling of the weight 20 and the link 34. The bevel pins 35 at the top ends of the link 34 are fitted into the pin holes 33 at the bottom portion of the piston container 30. When the motor 15 is connected to power and rotates, the main gear 16 will drive the transmission gear 22 to guide the link 34 to displace upwardly and downwardly.

Figure 5:
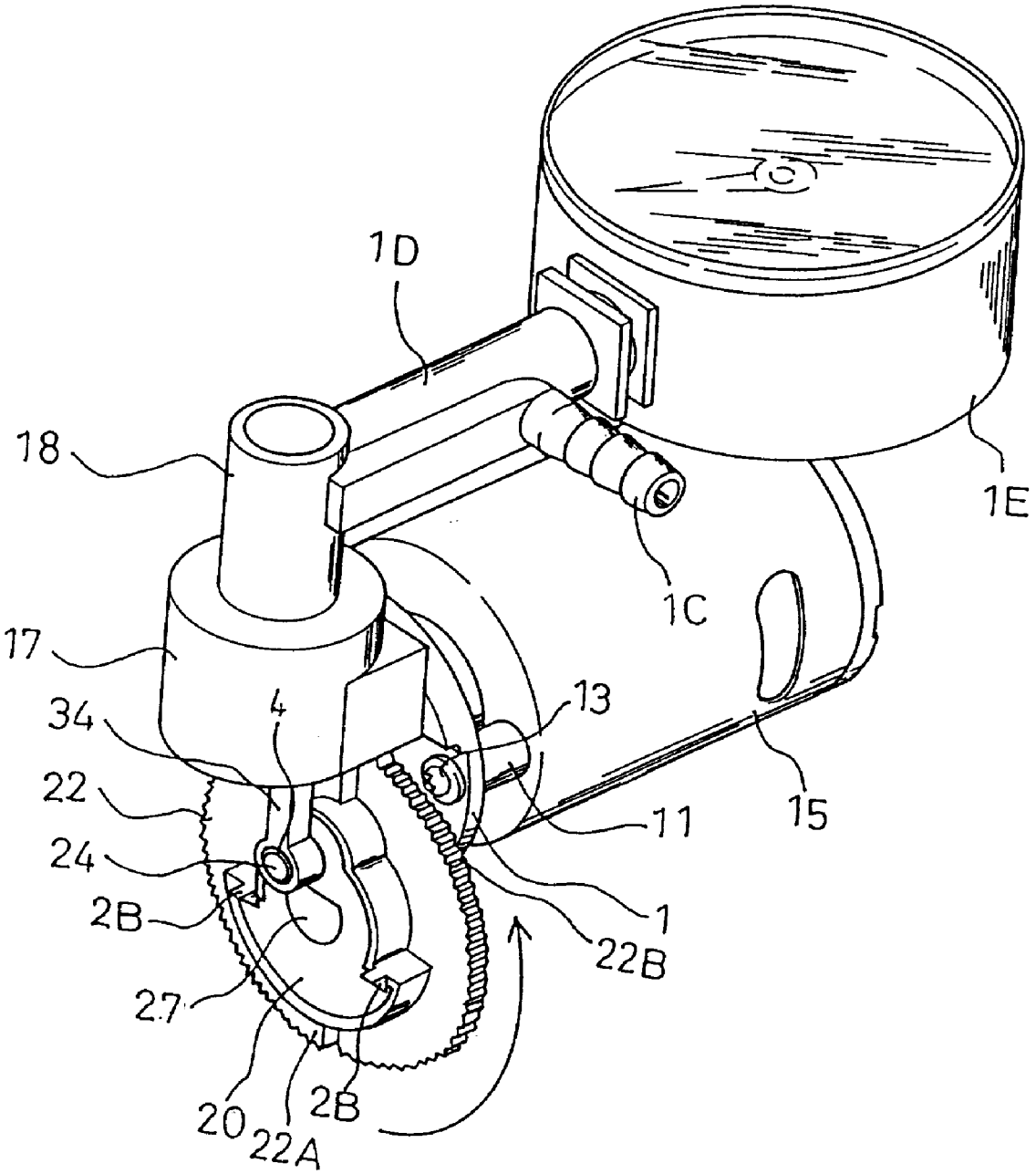
FIG. 5 illustrates the operation of the present invention.
Figure 6:
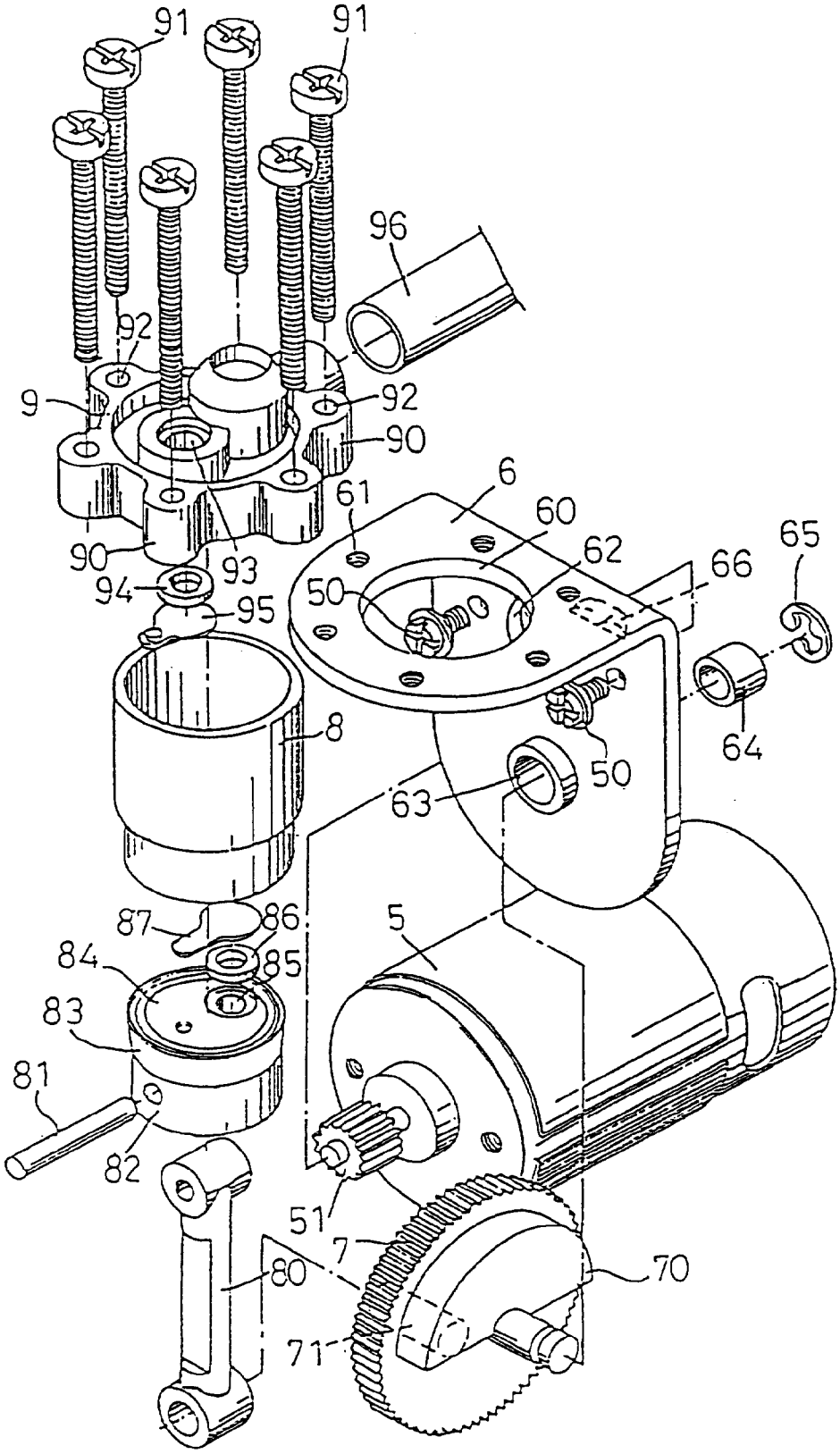
FIG. 6 is an exploded view of the prior art.

Referring to FIG. 5, when the motor 15 rotates, the main gear 16 drives the transmission gear 22 to further bring the weight 22 to rotate, so that the link 34 pivotally connected thereto displaces upwardly and downwardly to allow air intake and discharge. When the transmission gear 22 rotates in a counter-clockwise direction to an air discharge state, the thick toothed surface 22A of the transmission gear 22 will completely engage the teeth of the main gear 16 to enhance the transmission force, actuating the link 34 to cause the air inside the piston container 3 to be discharged to the outside, thus enhancing the air discharge effects of the compressor. When the transmission gear 22 rotates to an air intake state, the main gear 16 will engage the thin toothed surface 22B of the transmission gear 22. As the area of the teeth of the thin toothed surface 22B is relatively small, the coefficient of the friction generated is smaller. Added by the effect of the weight 20, the load of the motor may be reduced so as to enhance the efficiency of air discharge in the next operation, thus further speeding up the effects of air discharge. During air discharge, the main gear 16 and the transmission gear 22 bear the greatest force. In the present invention, the design of the thick toothed surface 22A helps to prevent damage to the teeth of the main gear 16 and the transmission gear 22 since the area of engagement between the teeth of the thick toothed surface 22*a* and the main gear 16 during rotation of the motor is increased.

I claim:

1. A structure for a compact air compressor, comprising a securing seat, a transmission device, and a compression device, wherein said securing seat is an integrally formed structure having a body which includes a cylindrical receiving slot communicating with a shaft receiving hole at an opposite side, and a pair of fitting tubes for securing screw rods, said receiving slot being provided with two opposite planar portions for receiving a sleeve having a projecting rim with opposite planar portions so as to prevent rotation of said sleeve, said screw rods being screwably locked with a motor having a main gear as a whole after being passed said fitting tubes, an integrally formed compression cylinder being disposed on said securing seat at a suitable position for mounting said compression device, a top end of said compression cylinder being connectably provided with a top tube which is internally provided with a valve block and a spring, said top tube being sealed by a cover urged by said spring to serve as a gas flow control, a guide tube and a threaded tube respectively extending from the body of said top tube, said threaded tube being adapted to screwably connect with a pressure gage as a whole; said transmission device including a weight, a link shaft, and a transmission gear, said weight being centrally formed with a substantially semi-circular shaft hole and having a connecting rod extending from a top end thereof and insertable into a connecting hole of a link of said compression device, said connecting hole having a bushing placed therein to enhance the smoothness of rotation of said connecting rod and reduce friction, one end of said link shaft being provided with an insert portion which is substantially semi-circular, the other end thereof being provided with a fastening groove, said transmission gear being further with a central through hole, and a receiving recess shaped to match said weight, said receiving recess having two shoulders and two retaining blocks being respectively disposed at said shoulders, one half of said transmission gear being provided with a thick toothed surface, with the other half thereof being provided with a thin toothed surface, said link shaft being passed through said shaft receiving hole of said securing seat and said sleeve with projecting rim, an E-shaped fastening clip being utilized to secure said link shaft in said fastening groove, said shaft hole of said weight being insertable into said insert portion of said link shaft to prevent slippage of said weight and said transmission gear from said link shaft, said weight just fitting into said receiving recess, and said retaining blocks at both shoulders of said receiving recess being utilized to position said weight in said transmission gear of two different thicknesses; and said compression device being comprised of a piston container, a compression valve, a compression positioning block, and a link, said piston container being provided with pin holes at a bottom portion thereof to receive bevel pins at the top ends of said link so as to achieve a linking-up structure, said connecting hole being provided in a bottom portion of said link for receiving said bushing and said rod, said link capable of guiding the movement of said piston container by means of the turning of said link shaft, a fastening post extending from the top end of said piston container, and a bevel fastening portion being formed at the top end of said fastening post for fastening both said compression positioning block and said compression valve to prevent their possible slippage, said fastening post being further provided with an air inlet which communicates with said piston container, an insert pin further extending from the top side of said fastening post, a valve piece being disposed on said insert pin and secured in place by a fastening portion of a limiting piece, whereby said sleeve is firstly fitted into said receiving slot of said securing seat, and said link shaft is passed through said shaft receiving hole and said sleeve, then said the weight is fitted into said receiving recess and positioned in place by said retaining blocks, one end of said link shaft being passed in sequence through said through hole of said transmission gear and said shaft hole of said weight by means of said insert portion, said weight and said transmission gear being prevented from slippage from said link shaft by said insert portion and said retaining blocks, the other end of said link shaft being secured to said securing seat by means of said E-shaped fastening ring which engages said fastening groove of said link shaft, said connecting rod of the weight 20 being next passed through said bushing fitted into said connecting hole of said link to allow coupling of said weight and said link, said bevel pins at the top ends of said link being fitted into said pin holes at the bottom portion of said piston container, said main gear driving said transmission gear to guide said link to displace upwardly and downwardly when said motor is actuated, thereby enhancing gas output efficiency.

* * * * *